US006923228B2

(12) United States Patent
Meyer et al.

(10) Patent No.: US 6,923,228 B2
(45) Date of Patent: Aug. 2, 2005

(54) VENEER-SLICING MACHINE

(75) Inventors: Jean Meyer, Friedewald (DE); Heinrich Webbler, Ludwigsau (DE); Armin Heiner, Hohenroda (DE)

(73) Assignee: Babcock-BSH GmbH, Bad Hersfeld (DE)

( * ) Notice: Subject to any disclaimer, the term of this patent is extended or adjusted under 35 U.S.C. 154(b) by 0 days.

(21) Appl. No.: 10/477,973

(22) PCT Filed: Mar. 12, 2002

(86) PCT No.: PCT/EP02/02681

§ 371 (c)(1),
(2), (4) Date: Nov. 14, 2003

(87) PCT Pub. No.: WO02/092303

PCT Pub. Date: Nov. 21, 2002

(65) Prior Publication Data

US 2004/0144447 A1 Jul. 29, 2004

(30) Foreign Application Priority Data

May 16, 2001 (DE) ..... 101 24 065

(51) Int. Cl.[7] ..... B27L 5/02
(52) U.S. Cl. ..... 144/178; 144/209.1; 144/162.1
(58) Field of Search ..... 144/356, 162.1, 144/178, 209.1–215

(56) References Cited

U.S. PATENT DOCUMENTS 4,089,354 A 5/1978 Cremona
4,137,957 A * 2/1979 Cremona ..... 144/178
4,587,616 A 5/1986 Weil
5,452,220 A * 9/1995 Ely ..... 700/167
5,511,598 A * 4/1996 Brand ..... 144/356
5,678,619 A 10/1997 Brand

FOREIGN PATENT DOCUMENTS

DE 25 48 164 12/1976
EP 127 175 5/1984

* cited by examiner

*Primary Examiner*—Derris H. Banks
*Assistant Examiner*—Shelley Self
(74) *Attorney, Agent, or Firm*—Herbert Dubno; Andrew Wilford

(57) ABSTRACT

In prior art veneer-slicing machines, the blade is always mounted so that its cutting edge is parallel to the plane of the table, inside of which a wooden beam can be clamped. As a result, it is not possible or only possible with a high degree of complexity, to make adaptations to the shape of the wooden beam, said shape being, for example, conical in some types of wood, or to the course of the grain in order to achieve an optimal sectional image and thus the best possible veneer quality. The inventive veneer-slicing machine should make it possible to make simple adaptations to the shape of the wooden beam or should be able to influence the sectional image. To this end, the tool slide (1) can be placed at an angle ($\alpha$) that is slanted with regard to the plane of the table (17). This is achieved by the provision of at least one articulated connection that is placed between the supporting structure (6) and the guide elements (5), which are mounted on rails (3) in a manner that permits them to move back and forth.

4 Claims, 4 Drawing Sheets

12
6a
27
24
25
22
A
5
3
24
25
5
3a
6b
26
23
A
22
3b
3

24
25
27
28
α

24
25
26
27a
27b

VENEER-SLICING MACHINE

CROSS REFERENCE TO RELATED APPLICATIONS

This application is the US national phase of PCT application PCT/EP02/02681, filed 12 Mar. 2002, published 21 Nov. 2002 as WO 02/092303, and claiming the priority of German patent application 10124065.1 itself filed 16 May 2001.

FIELD OF THE INVENTION

The invention relates to a veneer-slicing machine comprising a reciprocal table to which a flitch is clampable, the table being slidable on guide rails, and a tool slide carrying a pressure plate and a blade and reciprocal by hydraulic cylinders on a guide system along a line perpendicular to a movement plane of the table.

BACKGROUND OF THE INVENTION

In a typical veneer-slicing machine, as for example known from EP 0,127,175, the table to which the flitch to be sliced is clamped moves up and down in a vertical plane. To this end the table is guided by means of guide rails and shoes. A slice of veneer is cut from the flitch, e.g. as it moves downward, by an upwardly directed blade. The blade is mounted together with a pressure plate on a tool support that is normally stationary during the cutting operation. For each cycle of the table movement the tool support is advanced toward the flitch through a distance equal to the thickness of the veneer slice. The cutting edge of the blade and also the face of the tool support turned toward the table are parallel to the plane of the table.

German 2,548,164 describes a veneer-slicing machine with a vertically or nearly vertically movable table that when used reciprocates vertically with a flitch clamped to it. A tool carriage with a blade and pressure plate as well as a conveyor belt for carrying off the veneer slices is movable at a right angle to the table. The cutting edge of the blade is directed downward. The cutting is done during upward movement of the table.

Veneer-slicing machines with different arrangements of the table and blade are also known but they have no widespread use.

With the known veneer-slicing machines the attack angle, that is the angle between the cutting edge of the blade and the plane of the table against which the flitch is clamped, is fixed at 0°; the table plane and the cutting edge thus are parallel. Thus it is only limitedly and at great difficulty possible to conform the attack angle for instance to tapered flitches or so as better to follow their shape. This leads to lower-quality veneers.

OBJECT OF THE INVENTION

It is an object of the invention to provide a veneer slicing machine that makes it relatively easy to conform the angle between the cutting plane and the clamping plane of a flitch and thus to substantially improve the quality of the veneer.

SUMMARY OF THE INVENTION

The object is attained in means are provided for setting an angle between a plane of the table to which the flitch is clampable and the cutting edge of the blade.

The means for setting the angle between a plane of the table against which the flitch is clamped and the cutting edge of the angle ensures that veneers do not only have to be sliced off in a plane parallel to the table. Instead, the angle can be set in a practical range. Thus the cut can easily be conformed to various conditions so that at all times one can employ a cut plane optimized for veneer quality.

This ensures that even for example tree types with conical trunks can be used more for making veneer, or flitches whose grain runs differently than thought before rough-cutting of the piece can be optimally worked with respect to cut and veneer quality. This can be done without substantial investment of time or effort.

The size of the angle from −10° to +10° ensures that the last bit of the flitch that cannot be cut into veneer is still a marketable size.

BRIEF DESCRIPTION OF THE DRAWING

The invention is further described with reference to a simplified illustrated embodiment of a veneer-slicing machine with vertical table guides. Therein, schematically.

SPECIFIC DESCRIPTION

Figure 1:
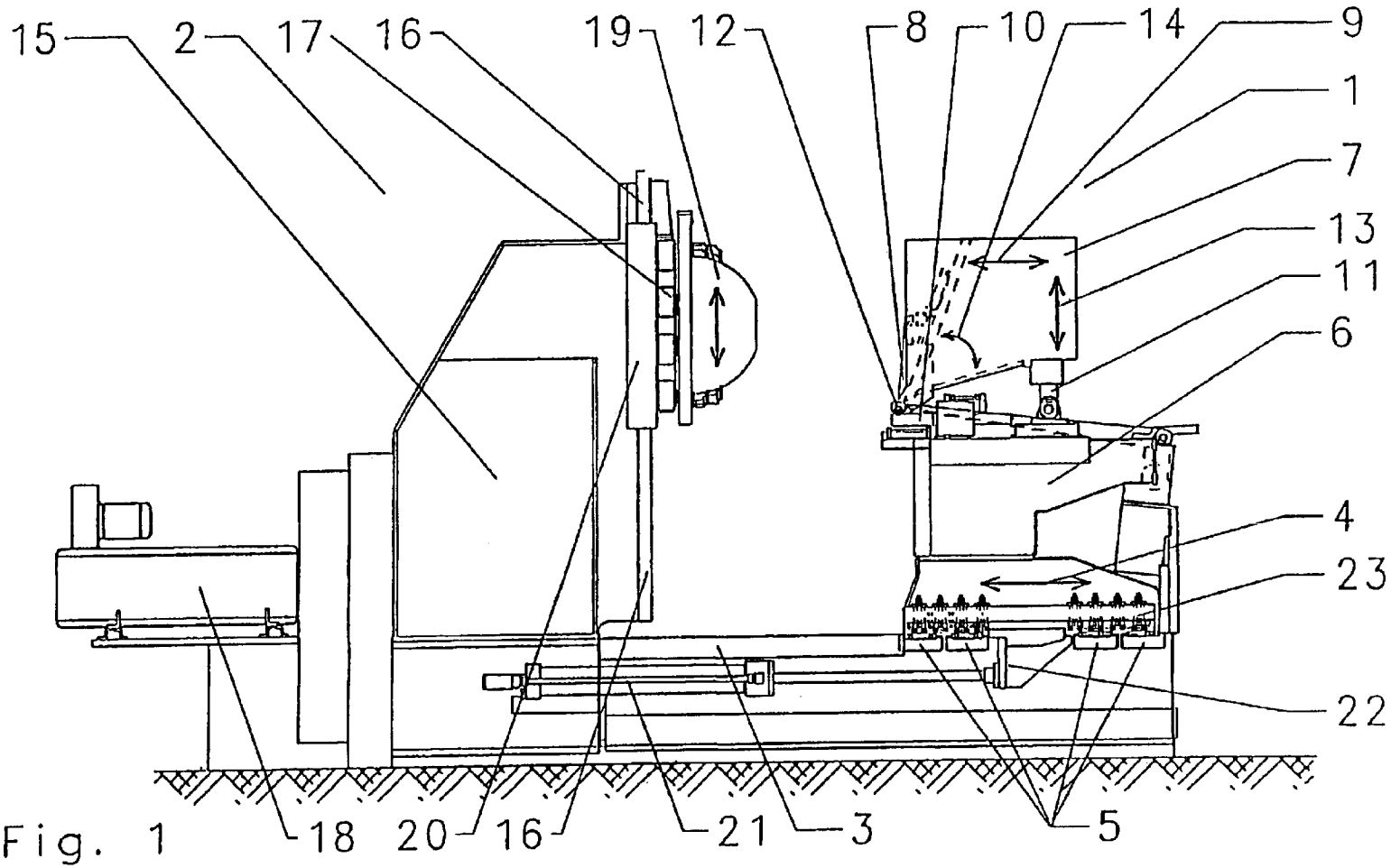
FIG. 1 is an end view of a veneer-slicing machine.

As shown in FIG. 1 a slicing machine is basically formed by a tool carriage 1 and a table assembly 2.

The table assembly 2 is basically formed by a machine frame 15, guide rails 16 that are fixed to the machine frame 15, a table 17, and a drive motor 18. The table assembly 2 is fixed to the floor and positioned relative to the tool carriage 1 such that the cutting edge of a blade 8 of the carriage 1 is parallel to the table face to which a flitch 19 is clamped. The guide rails 16 are fixed on the machine frame 15. They each form with the vertical an acute angle, and their faces turned away from the machine frame 15 lie in a plane. The table 17 is secured by slide shoes 20 each formed by several parts on the guide rails 16 and is vertically reciprocal in a vertical plane along the guide rails 16. A flitch 19 is as is standard clamped by unillustrated hydraulic claws to the table 17.

The table 17 is movable on the guide rails 16 by means of the slide shoes 20. The slide shoes 20 are removably mounted on the table 17. Between each slide shoe 20 and the respective guide rail 16 are wear elements that are also removable from the slide shoes 20 so that the play between the slide shoes 20 and the guide rails 16 can be adjusted. Here the play is set as small as-possible so as to optimize the precision of the cut.

Figures 3, 5:
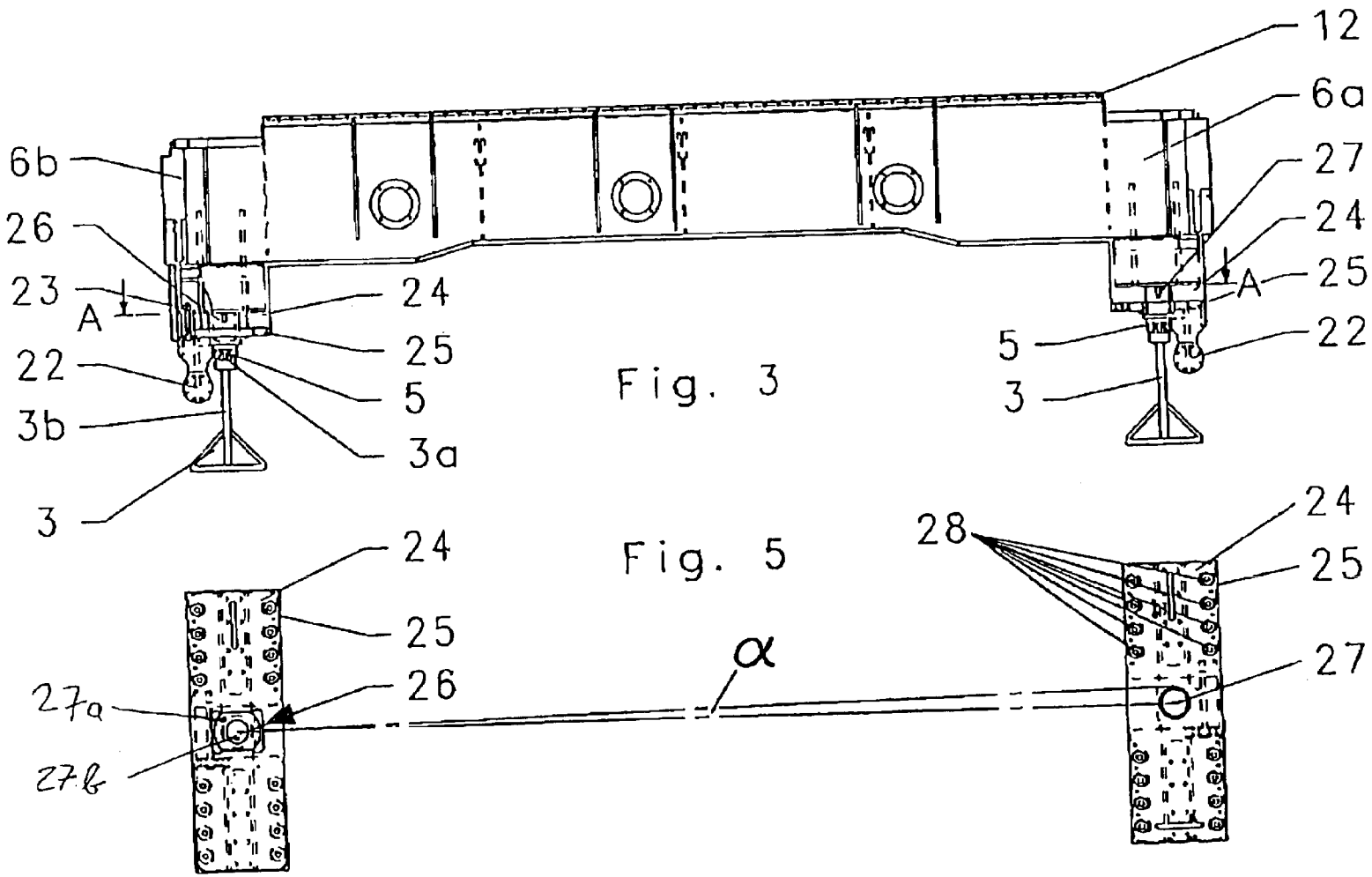
FIG. 3 is a view of a tool carriage without a blade holder seen from the side of table.
FIG. 5 is a section taken along line A-A of FIG. 3 from above.

Two hydraulic cylinders 21 reciprocate the tool carriage 1 as shown by arrow 4 along two generally horizontal and parallel rails 3 that are fixed to the floor. Each rail 3 is comprised of a guide rail 3*a* and a support structure 3*b* (FIG. 3). Each hydraulic cylinder 21 is braced at one end on an abutment 22 of a frame 6 of the carriage 1 and at the opposite end on one of the fixed rails 3. The tool carriage 1 is movable perpendicularly and with minimal play along the rails 3 via guide elements 5 that are fixed on the frame 6 so that during cutting of the flitch 19 into veneer it is only possible to move along the rails 3. The rails 3 and the guide elements.5 form a guide system.

An upper portion of the carriage frame 6 carries a blade support 7 with the blade 8 that is vertically adjustable in the direction of arrow 13, and pivotal about a downwardly directed cutting edge of the blade 8. The blade 8 is mounted on a side of the blade carrier 7 that confronts the table assembly 2. The blade carrier 7 can be moved relative to the carriage frame 6 as indicated by arrows 9, 13, and 14, as is necessary for adjusting its position with respect to a pressure plate 12 described below, by various hydraulic cylinders of which for clarity of view only two are shown at 10 and 11.

Below the blade 8 and parallel to it on the machine frame 6 is the pressure plate 12. The pressure plate 12 and blade 8 are set such that in use they are spaced slightly apart.

The machine frame 6 carries further unillustrated devices for carrying off a slice of veneer.

The above structure of the veneer-slicing machine corresponds to the state of the art.

Figure 2:
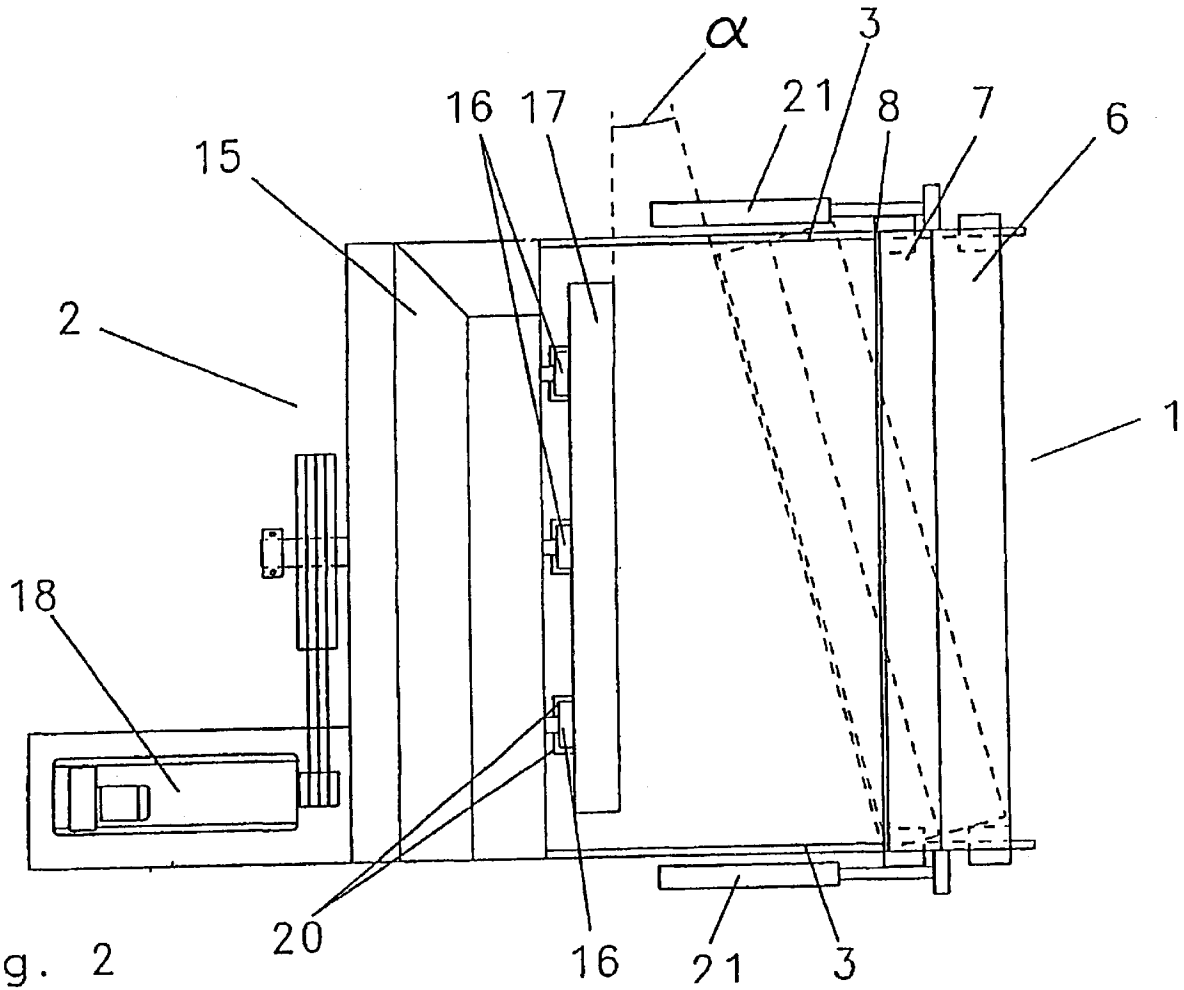
FIG. 2 is a view like FIG. 1 from above.

As shown in FIG. 2 the tool carriage 1 can be set at an acute angle $\alpha$, which here is shown bigger than in practice for illustration purposes, relative to the table assembly 2, here relative to the vertical plane of the table 17. To this end the tool carriage 1 is pivotal about a vertical axis so as to form an acute angle between the vertical table plane and the (substantially horizontal) cutting edge of the blade 8 in a horizontal plane.

Figure 4:
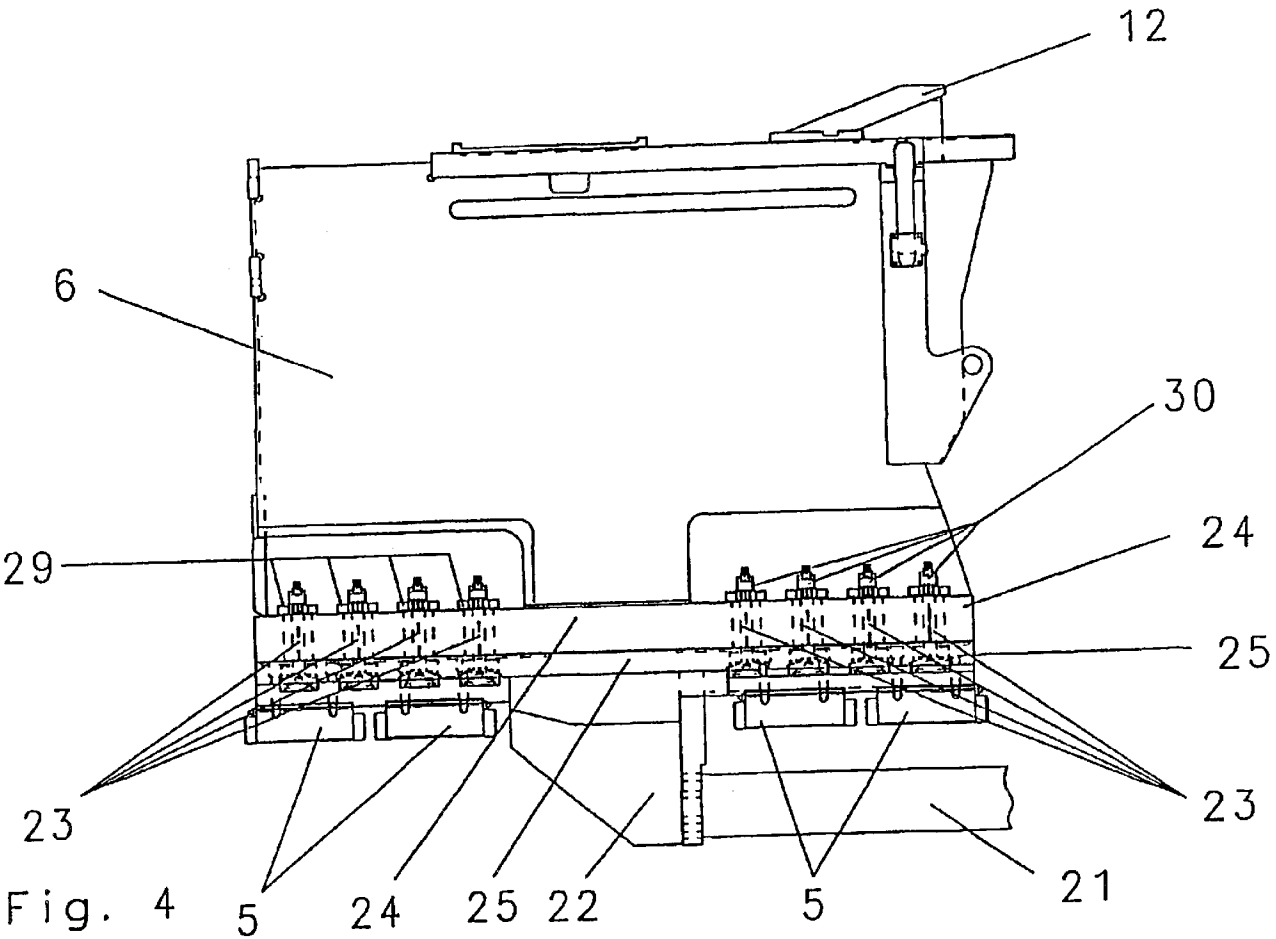
FIG. 4 is an enlarged view like FIG. 3 without rails.

The means for setting the angle $\alpha$ is more closely described with reference to FIGS. 3 to 5.

Each longitudinal side 6*a* and 6*b* of the frame 6 is connected to the respective guide element 5 on the respective rail 3 by a pivot as follows:

A massive rectangular plate 24 is fixed against relative movement. e.g. by welding, underneath the right-hand end 6*a* of the frame 6. A face of the plate 24 is perpendicular to the adjacent side of the frame 6 and here is horizontal. The longitudinal axis of each plate 24 is directly above the longitudinal axis of the respective rail 3 when the cutting edge of the blade 8 is parallel to the table 17, that is when $\alpha=0°$. A mainly round, throughgoing central, and perpendicular hole formed in the face of the plate 24 coaxially and rotatably receives a circular-section bolt 27 that is flush at its upper end with the face of the plate 24 but that projects downward from it. The bolt 27 is axially fixed in the hole. The face of the plate 24 is also formed near its longitudinal edges with four groups of four throughgoing bores 28.

Underneath each plate 24 is a second plate 25 that carries the upper plate 24. This second plate 25 has the same overall dimensions, a hole receiving the bolt 27, and the same bores 28 as the upper plate 24. The plates 24 and 25 abut at a plane and are congruently aligned when $\alpha=0°$.

Each pair of aligned bores 28 of the plates 24 and 25 receives a respective piston of a hydraulic actuator 23, the diameters of the bores 28 being so large that there is play, e.g. of 15 mm, around the piston of the respective actuator 23.

Each actuator 23 is indirectly, e.g. via a further plate, or directly fixed to the lower plate 25. Each piston has a free end remote from the working cylinder of the respective actuator 23 and formed with a screwthread whose outside diameter is smaller than that of the piston. Each such screwthread is fitted with a stiff washer 29 that is secured by means of a nut 30 on the free end of the piston. The washer 29 has an outside diameter that is greater than the inside diameter of the respective bore 28 in the plate 24 so that each washer bears with the outer periphery of its lower face on the upper plate 24. The threaded end of the piston projects with some play through the central hole of the washer 29.

The actuators 23 can press the plates 24 and 25 together so that they form when clamped a rigid connection whereas when unclamped they permit relative shifting and/or pivoting of the plates 24 and 25.

The pivotal connection at the left end 6*b* of the frame 6 is identical to that on the right end 6*a* except that the hole in the upper plate 24 and its bolt 26 are different: The hole is formed as an elongated slot whose longitudinal axis is perpendicular to the longitudinal axis of the respective plate 24. The hole receives a disk which is a snug fit to the longitudinal edges but which has several mm of play to the slot ends. A central hole of the plate pivotally receives the bolt 26.

In use except for setting the angle $\alpha$ between the table plane and the cutting edge of the blade 8, everything is the same as in the prior art, that is the tool carriage 1 is first set at the maximum possible spacing from the table 2, the so-called starting position. A flitch 19 is secured by the claws to the table 17 and the tool carriage 1 is set in the desired inclined position.

To this end all the actuators 23 are released, that is set to maximum length. One of the hydraulic cylinders 21 is moved in or out by the desired amount of for example ±100 mm (according to the angle $\alpha=0°$). This shifts one end of the frame 6 along one of the rails 3, thereby pivoting the frame 6 on the bolts 26 and 27 and thus establishing the desired inclined position between the tool carriage 1 and the clamping plane of the table 17. The bolt 26 permits some length compensation that is necessary along the connecting line between the bolts 26*b* and 27 as a result of the change in the angle $\alpha$. Each angle $\alpha$ corresponds to a predetermined displacement that must be effected by inward or outward movement of the hydraulic cylinder 21 and is determined by the geometry of the tool carriage 1. As soon as it is set in the desired angle $\alpha$, all the actuators 23 are pulled in and pressurized so that the plates 24 and 25 are solidly pressed together. In this manner the inclination at the angle $\alpha$ is fixed and the frame 6 cannot move relative to the guide elements 5 so that the carriage 1 is precisely guided and the cuts will be exact.

The angle $\alpha$ is only adjusted when a change is needed.

It is preferable when the hydraulic cylinder 21 used to change inclination is the one remote from the bolt 26 which in addition to pivoting also shifts longitudinally.

The tool carriage 1 is now advanced by simultaneous extension of the two hydraulic cylinders 21 into a working position that leaves a very small horizontal space between the flitch 19 and the cutting edge of the blade 8. The drive for the table 17 is turned on so as to vertically-reciprocate the table 17 when it is up to speed and at a lower end position of the table 17, the tool carriage 1 is moved toward the flitch 19 such that during the next upward movement a slice of veneer of the desired thickness is cut off.

Once the table 17 reaches its upper end position, the tool carriage 1 is pulled back slightly so that the flitch 19 is not touched when moving back down. In the lower end position of the table 17 the tool carriage 1 is again indexed back through a distance equal to the desired thickness of the veneer from the previous position. This cycle is repeated until so many veneer slices have been cut from the flitch 19 that nothing but a minimal scrap of the flitch 19 is left.

In order to get rid of the scrap of flitch 19, the tool carriage 1 is returned to the rest position. A new flitch 19 is clamped in place and the process is restarted.

During the entire operation except for setting the angle $\alpha$ the two hydraulic cylinders 21 are operated identically so that the tool carriage 1 moves parallel on the rails 3.

What is claimed is:

1. A veneer-slicing apparatus comprising:

a table adapted to hold a flitch;

two rails extending parallel to a longitudinal direction from the table and spaced apart transversely of the direction;

a frame spaced in the direction from the table;

respective guide elements on the frame riding on the rails, whereby the frame is shiftable in the direction relative to the table;

means for relatively reciprocating the table and the frame along a plane transverse to the direction;

a blade carried on the frame and having a cutting edge;

means including two actuators operatively engaged between the table and the frame and spaced apart transversely of the direction for relatively displacing the table and the frame in the direction in steps while the table and frame are being relatively reciprocated to cut slices of veneer from the flitch on the table; and means connected to one of the actuator and including a pivot between one of the guide elements and the frame for pivoting the blade about an axis generally parallel to the plane and transverse to the direction between a position with the cutting edge parallel to the plane and a position with the cutting edge forming an acute angle with the plane and for securing the blade on the frame in either of the positions.

2. The veneer-slicing apparatus defined in claim 1 wherein the angle can vary 10° to either side of the position with the cutting edge parallel to the plane.

3. The veneer-slicing apparatus defined in claim 1 wherein the means for pivoting further includes clamp means between the other of the guide elements and the frame.

4. The veneer-slicing apparatus defined in claim 3 wherein the clamp means includes a lower plate on the other of the guide elements, an upper plate on the frame, and actuator means for pressing the plates against each other.

* * * * *